United States Patent [19]

Nagasaki et al.

[11] Patent Number: 4,563,009

[45] Date of Patent: Jan. 7, 1986

[54] GOLF PUTTING PRACTICE DEVICE

[75] Inventors: Haruki Nagasaki; Shoji Fujikawa; Koichi Iwanaga, all of Hikone, Japan

[73] Assignee: Matsushita Electric Works, Ltd., Osaka, Japan

[21] Appl. No.: 654,565

[22] Filed: Sep. 26, 1984

[30] Foreign Application Priority Data

Oct. 24, 1983 [JP] Japan ..... 58-198853

[51] Int. Cl.[4] ..... A63B 69/36

[52] U.S. Cl. ..... 273/179 B

[58] Field of Search ..... 273/179 A, 179 R, 179 B, 273/179 C, 34 A, 127 C, 176 F, 176 FA

[56] References Cited

U.S. PATENT DOCUMENTS

| | | | |
|---|---|---|---|
| 2,308,785 | 1/1943 | Smith | 273/179 B |
| 2,443,759 | 6/1948 | Anderson | 273/179 A |
| 2,908,503 | 10/1959 | Austin et al. . | |
| 2,991,083 | 7/1961 | Hartung | 273/179 B |
| 3,310,312 | 3/1967 | Peeples | 273/179 A |
| 3,540,733 | 11/1970 | La Mattina | 273/179 A X |

*Primary Examiner*—Paul E. Shapiro

*Attorney, Agent, or Firm*—Burns, Doane, Swecker & Mathis

[57] ABSTRACT

A golf putting practice device comprises a ramp having a hole therein and a lifter for removing the ball from the hole. The ball lifter includes a lifting lever disposed in the hole and rockable between a non-actuated position for receiving a ball and a vertically actuated position for discharging the ball out of the hole in a rearward direction with respect to the lowest front end of the ramp direction. A slanted track receives the discharged ball and permits it to roll forwardly along one side edge of the ramp. A ball returner springs the back to the player.

9 Claims, 9 Drawing Figures

Fig. 1
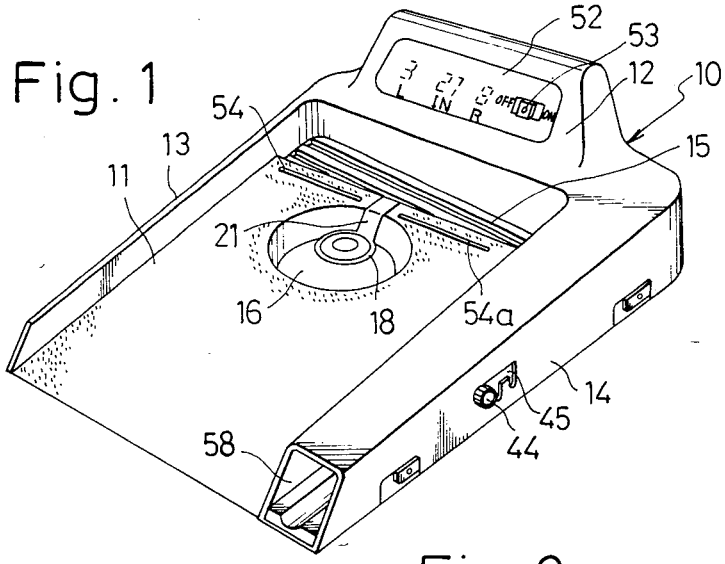
Fig. 2
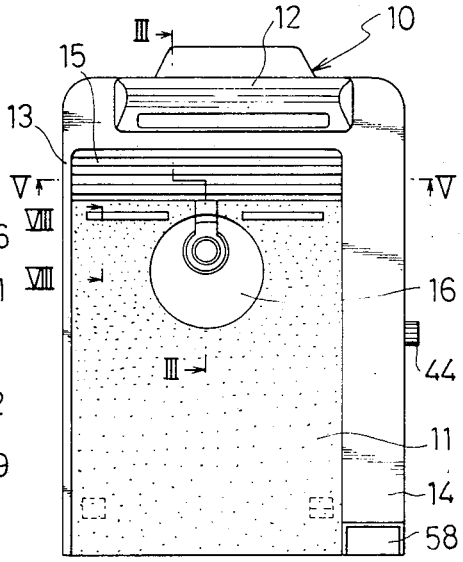
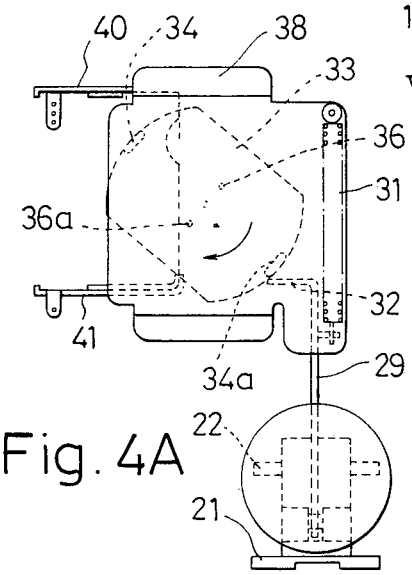
Fig. 4A

GOLF PUTTING PRACTICE DEVICE

TECHNICAL BACKGROUND OF THE INVENTION

This invention relates to a golf putting practice device for use mostly indoor.

The golf putting practice devices of this kind are designed in many instances to have putted balls returned from the device to the player, including the balls holed in a hole provided in a ramp of the device having a proper angle of inclination so that the player can repeat sequentially his putting practice.

DISCLOSURE OF PRIOR ART

In such an exemplary one of known golf putting practice devices as disclosed in U.S. Pat. No. 2,908,503 of Charles G. Austin et al, a ball conveying means disposed inside the hole to communicate therewith is extended rearward from the hole, and a ball return means comprising a solenoid and plunger device is disposed at the rear end of the ball conveying means, so that the ball holed in is automatically hit back from the hole to the player by the plunger driven electromagnetically, while a ball not holed in is caused to roll down the ramp toward the player or into the hole to be also hit back.

Various putting practice devices of similar arrangements have been suggested. However, in all of them, the ball is returned by the device directly back from the hole so that the ball will run along substantially the same line as that of the putting, and the player cannot perform his next putting action until the ball being returned reaches his position or goes out of the putting line, causing disadvantageously the practice efficiency to be lowered. Yet, the device of the above U.S. patent is disadvantageous in that, as the ball fell into the hole is conveyed rearward to the ball return means and is thereby hit back again to the hole to be discharged thereout, the hole has to be made deep on its rear side enough for passing the ball but shallow on the front side enough for easily discharging the ball, and the ramp which defines the hole must be of a considerably larger angle of inclination rendering the ball to be rather hard to cup in or to be easy to hop out of the hole without being conveyed rearward. Further, the use of solenoid and plunger device requires a large energy and thus the use of a commercial power source is necessitated to have the device limited in its portability.

TECHNICAL FIELD OF THE INVENTION

A primary object of the present invention is, therefore, to provide a golf putting practice device which provides a ball returning line separated from the putting line allowing sequential putting practice to be made irrespective of returned ball.

Another object of the present invention is to provide a golf putting practice device in which a sufficiently deep hole is made in a ramp having a proper angle of inclination for the putting and yet holed-in ball is smoothly discharged out of the hole to be returned along a line traced aside the putting line.

Still another object of the present invention is to provide a golf putting practice device in which means electrically actuated with a relatively small energy is employed only in a part of ball return means so that the device can be battery powered for a high portability.

Other objects and advantages of the present invention shall become clear from the following description of the invention detailed with reference to an embodiment shown in accompanying drawings.

BRIEF EXPLANATION OF THE DRAWINGS

FIG. 1 is a perspective view of a golf putting practice device according to the present invention;

FIG. 2 is a plan view of the device of FIG. 1;

FIG. 4A is a fragmentary plan view of a ball discharging means seen in FIG. 4 but in its actuated position different from that in FIG. 4;

Figure 6:
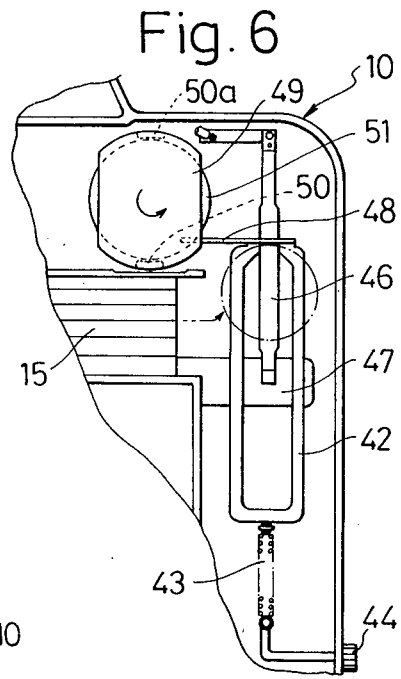
FIG. 6 is a fragmentary plan view of the device of FIG. 1 showing a ball return means with the covering member removed.
Figure 3:
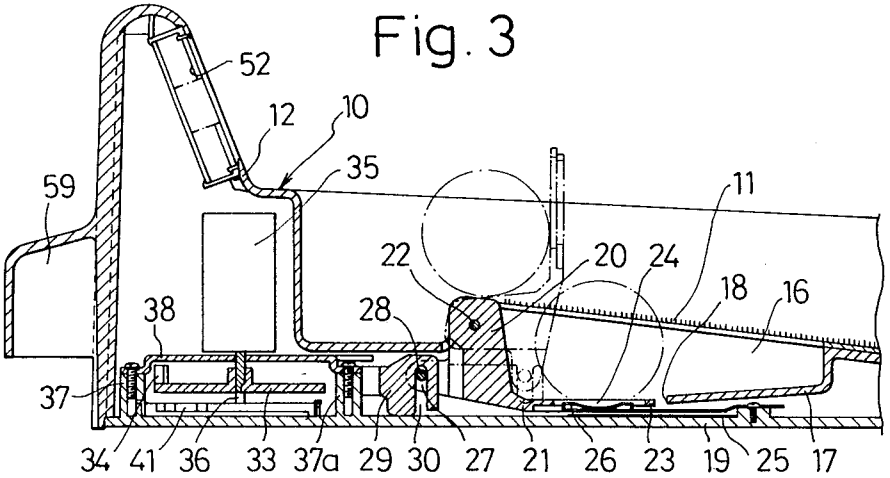
FIG. 3 is a partial and vertically sectioned view of the device of FIG. 1 taken along line III—III in FIG. 2.

While the present invention shall now be described with reference to the preferred embodiment shown in the drawings, it should be understood that the intention is not to limit the invention only to the particular embodiment shown but rather to cover all alterations, modifications and equivalent arrangements possible within the scope of appended claims.

DISCLOSURE OF PREFERRED EMBODIMENT

Referring to FIGS. 1 to 4, there is shown a golf putting practice device 10 which includes a ramp 11 having a proper angle of inclination with respect to floor surface. The ramp 11 is enclosed by a main transverse housing part 12 having one side wall part 13 and the other side covering part 14 for a ball returning path, the both side parts being integrally connected to the main housing. The ramp 11 is designed so that, when the putting device is placed on the floor surface, the front and lowest level end edge left open of the ramp 11 will be substantially flush with the floor surface. In this case, the both side parts 13 and 14 are preferably also inclined slightly forwardly. Behind the highest level end edge of the ramp 11, a ball-rolling track 15 which extends along the main housing part 12 and has preferably a plurality of longitudinal grooves. More specifically, the track 15 is sloped down from the one side wall part 13 to the other side covering part 14 at an angle of, for example, about 5 degrees, and extends into the covering part 14. A circular hole 16 having the size substantially of golf course cup is made in the ramp 11 adjacent the highest end edge and in the center of the ramp with respect to the length of the track 15, and a bottom wall 17 in the hole 16 is inclined slightly rearward and formed to have a round aperture 18 on rearward side of the hole. The main housing part 12 and both side parts 13 and 14 are secured at their bottom end edges to a bottom plate 19 which expands all over the plane defined by these bottom edges, so that an interior space will be defined in cooperation with the ramp 11.

A lifting lever 21 forming a part of ball lifting means is pivotably connected at its upper base part to a rear side wall 20 of the hole 16 by means of a pin 22 so that, when the means is not actuated, a ball receiving disc 23 of the lever 21 lies in the round aperture 18. The disc 23 itself is provided with a concentric round opening 24 into which a golf ball can smoothly seat. A first pair of fixed contactor 25 and resilient movable contactor 26 are secured to the bottom plate 19 so that their opposing contact parts will be at a position corresponding to the opening 24 of the lifting lever 21 in the non-actuated position, with the movable contact part of the contactor 26 disposed above to be within the opening 24. The lifting lever 21 is linked at its rearward projection 27 having a pivot pin 28 positioned below the pin 22 to a pushing arm 29 forming another part of the ball lifting means, with the pin 28 engaged in a notch 30 of the arm 29 which is supported movably in forward and rearward directions on the bottom plate 19. The arm 29 is normally biased by a tension spring 31 into a rearward retracted position so as to retain the lever 21 at its lower position inside the hole 16 as shown by solid lines in FIG. 3 but, when the arm 29 is shifted to a forward protruded position shown by chain lines in FIGS. 3 and 4 against the force of the spring 31, the lever 21 is rotated about the pin 22 as the center substantially by 90 degrees up to such a vertically disposed upper position as shown by chain lines in FIG. 3.

The pushing arm 29 is provided at its rearward end with a laterally projected lug 32 which is engageable with each of two diametrally opposing upward projections 34 and **34*a* of a first rotary actuating plate 33 of a contour having two parallel edges obtained by symmetrically cutting a circular plate with respect to a diametral direction in which the projections 34 and 34*a* oppose, while the plate 33 is fixed at its center to an output rotary shaft of a vertically disposed first drive motor 35 to be thereby rotated. The first rotary actuating plate 33 is further provided with a pair of downward projected pins 36 and 36*a* at symmetrical positions opposing each other in a direction transversing the opposing direction of the upward projections 34 and 34*a*. The first motor 35 is mounted on a plate 38 screw-fastened to a pair of bosses 37 and 37*a* upstanding from the bottom plate 19, and is electrically connected through a proper electric power supply line (not shown) including the fixed and movable contactors 25 and 26 to batteries contained in a receptacle 39 of the bottom plate 19 so that, when the contactors are closed by the weight of the ball holed in to seat on the disc 23**, the motor is activated by the power supplied from the batteries.

The output shaft of the first motor 35 extends downward through the mounting plate 38 and is secured to the first actuating plate 33 disposed below the plate 38. A second pair of fixed and movable contactors 40 and 41 are provided on the bottom plate 19 to be disposed below the first actuating plate 33 so that, when the movable contactor 41 comes into contact with the fixed contactor 40 in a manner later described, the motor 35 also receives the power through a proper power supply line (not shown) from the batteries to keep rotating while the contactors 40 and 41 are being closed.

Figure 4:
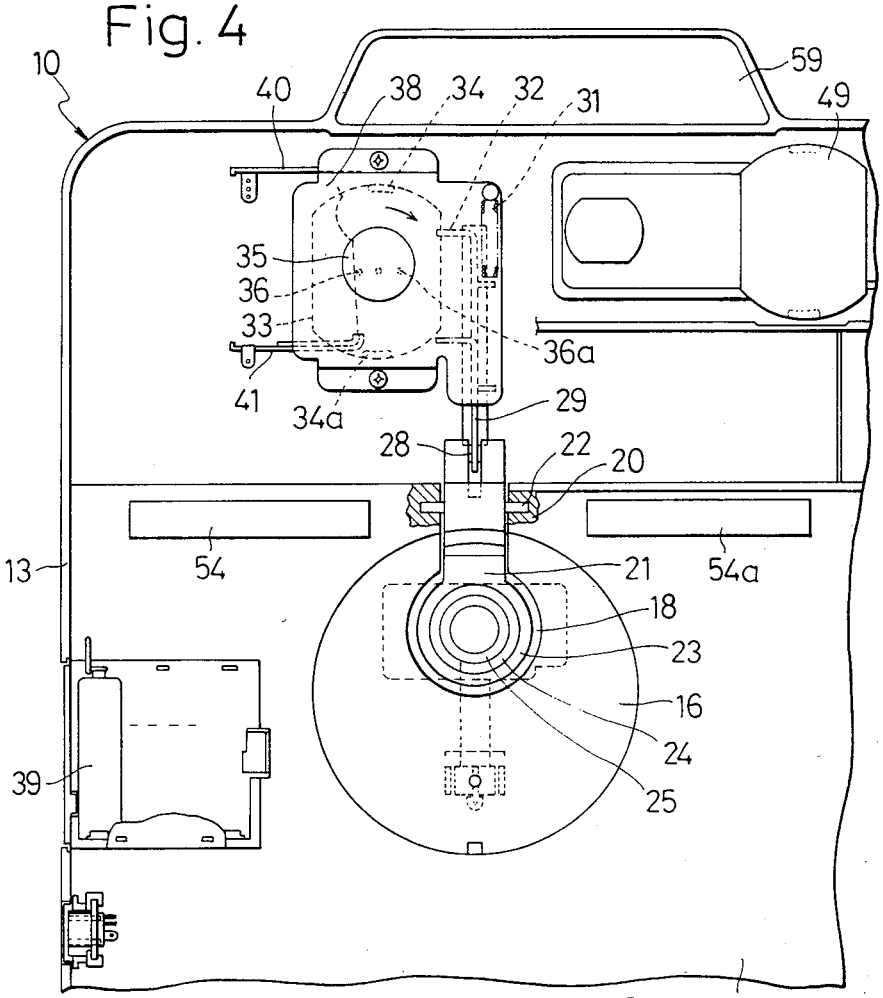
FIG. 4 is a partial plan view as magnified of the device of FIG. 1 with a part of covering member removed.

With the above arrangement of the ball lifting means, the closing of the first pair of contactors 25 and 26 causes the motor 35 to start rotating with the actuating plate 33. As this plate 33 rotates, in FIG. 4, the projection 34 of the plate 33 comes into engagement with the lug 32 of the pushing arm 29 and, with further rotation of the plate, the projection 34 drives the arm 29 to be protruded forward to the position of FIG. 4A, so as to rotate the lifting lever 21 coupled to the arm 29 upward about the pin 22. With this rotation of the lever 21 with the ball, the first movable contactor 26 is separated from the fixed contactor 25 but, with the rotation of the plate 33, the second fixed and movable contactors 40 and 41 which have been opened by the downward pin 36 as in FIG. 4 are closed because the pin 36 is disengaged from the second movable contactor 41 to cause it contacted with the fixed contactor 40 as in FIG. 4A during the forward driving of the arm 29 with the projection 34 being rotated, so that the motor 35 will continue to rotate until the other actuating pin **36*a* comes into engagement with the second movable contactor 41 to open the second pair of contactors 40 and 41 immediately after a separation of the projection 34 from the lug 32 of the arm 29 to cause it returned to the retracted position by the spring 31**.

Figure 5:
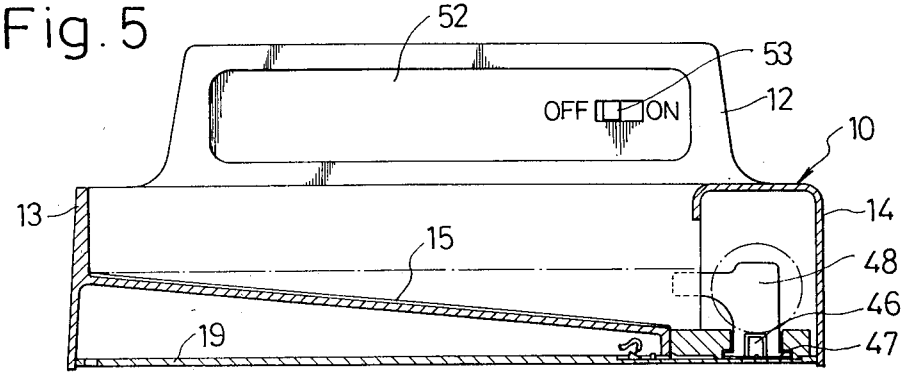
FIG. 5 is a cross-sectional view of the device of FIG. 1 taken along line V—V in FIG. 2.
Figure 7:
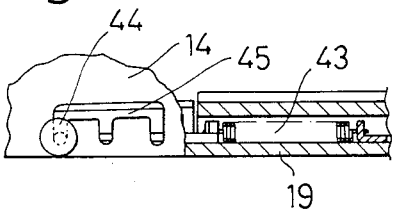
FIG. 7 is a partial side view showing partly in section a part of the ball return means in the device of FIG. 1.

Referring next to FIGS. 5 and 6, a ball return means is disposed adjacent the lowest level end of the sloped ball-rolling track 15 as positioned at a connection between the main housing part 12 and the covering part 14 of the ball returning path lying along the ramp 11 and opened at 58 (FIG. 2). More specifically, the ball return means includes a ball returning arm 42 which is disposed to be movable in the forward and rearward directions on the bottom plate 19 and is always biased in forward direction to the open lowest level end of the slope 11 by a tension spring 43. In this embodiment, the spring 43 is hung between the arm 42 and an inner projected end of a biasing-force adjusting knob 44 fitted slidably in a position-selecting slot 45 having differently positioned notches (FIG. 7) for providing different tension spring forces. The ball return arm 42 is provided on its upper side with a third resilient movable contactor 46 so that the ball rolled onto the contactor 46 will cause it to contact with a third fixed contactor 47 disposed below the arm 42. This movable contactor 46 is inclined slightly rearward so as to have the ball positioned at the rearward end of the ball return arm 42 as shown by a chain line in FIG. 5, as rolled down from the track 15.

The ball return arm 42 is provided at its rear end with a lever 48 which extends vertically upward with respect to the body of the arm 42 and laterally toward a second rotary actuating plate 49 having diametrally opposing projections 50 and **50*a* and secured at its center to an output rotary shaft of a second drive motor 51 disposed below the plate 49, substantially in the same arrangement as the first actuating plate 33. Thus, the laterally extended lever 48 is engageable with each of the projections 50 and 50*a* as the plate 49 rotates with the motor 51 actuated through the third pair of the fixed and movable contactors 46 and 47 closed by the ball rolled onto the movable contactor 46 for a power supply through a proper power supply line (not shown) from the batteries in the battery receptacle 39 to the motor 51**.

In the ball return means of the above arrangement, the thus actuated motor 51 rotates the actuating plate 49 counterclockwise in FIG. 6, and the projection 50 of the actuating plate 49 engages the lever 48 of the ball return arm 42 to cause, with further rotation of the plate 49, the arm 42 to be driven rearwardly against the tension force of the spring 43. When the rotary actuating plate 49 further rotates, the projection 50 is disengaged from the lever 48, and the ball return arm 42 is caused to be quickly returned to the original position by the resilient force of the spring 43.

Figure 8:
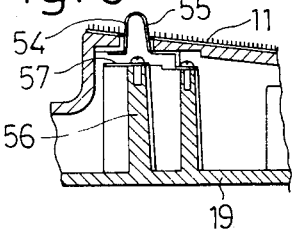
FIG. 8 is a partial and vertically sectioned view of the device of FIG. 1 taken along line VIII—VIII in FIG. 2.

The device 10 of the present instance is further provided, as mounted in the main housing part 12, with a putting count display 52 and a main switch 53 for turning on and off an electric circuit for the display. Upon closing of the first fixed and movable contactors 25 and 26 by the ball holed in, one of count inputs to the display 52, that is, a hole-in signal is provided. When the putted ball misses the hole to deviate to either left or right hand side thereof, this can be also counted and displayed by output signals of OUT detectors 54 and 54*a* disposed on both sides of the hole 16 as shown in FIG. 4. Each of the detectors 54 and 54*a* comprises, as shown in FIG. 8, a fourth pair of movable and fixed contactors 55 and 57, in which the movable contactor 55 resiliently projects out of the ramp surface to be depressed by the ball rolled over the contactor 55 so as to come into contact with the fixed contactor 57 mounted on an upstanding support 56 of the bottom plate 19. When the fourth pair of contactors 55 and 57 are closed, signals indicative either of leftward or rightward misses of the putted balls are provided from the respective detectors 54 and 54*a* to the display 52 to be accumulatively indicated.

The operation of the golf putting practice device according to the present invention shall be described next as summarized. When the ball putted by the player successfully drops into the hole 16, the ball is seated on the disc 23 of the ball lifting lever 21 which is positioned in the bottom of the hole as shown by solid lines in FIG. 3, whereby the first pair of fixed and movable contactors 25 and 26 are closed. Whereupon, the first drive motor 35 is energized to rotate the first rotary actuating plate 33 so that one of the actuating projections 34 and 34*a* urges the pushing arm 29 to be advanced. Then, the lifting lever 21 swings about the pivot pin 22 by about 90 degrees counterclockwise in FIG. 3 to such upright position as shown by chain lines in the drawing. Simultaneously, the ball is discharged out of the hole 16 and dropped into the sloped ball rolling track 15 lying behind the hole 16 and along the highest level end edge of the ramp 11.

The ball fell into the track 15 rolls down along the track 15 into the ball return path covering 14 to ride on the third movable contactor 46 disposed adjacent the lowest level end of the track 15, the third pair of the fixed and movable contactors 46 and 47 are thereby closed, and the second drive motor 51 is energized to rotate the second rotary actuating plate 49, whereby the ball return arm 42 is retreated against the tension force of the spring 43 by means of one of the actuating projections 50 and 50*a* on the plate 49. When the actuating plate 49 is further rotated, the ball return arm 42 is released to spring back to the original position by the returning force of the spring 43, and the ball on the arm is frictionally ejected onto the ball return path lying inside the covering 14 to be discharged out of the opening 58 and returned toward the player. On the other hand, the ball putted and missed to hole in but directly dropped into the ball rolling track 15 can be also automatically returned toward the player by the ball return means in the same manner as above.

Concurrently with the foregoing ball return operation, such results as, for example, three types of the putted balls including the ones holed in and missed leftward and rightward are indicated on the display 52 in order to inform the player of the putted lines clearly.

With the above arrangement, since the opening 58 of the ball return path covering 14 is located on one of lateral sides of the ramp 11, the ball returning line can be separated from the putting line and thus the player can repeat sequentially the putting practice without being bothered with by the returned balls. In returning the ball specifically from the device to the player, the resilient biasing force of the spring is effectively utilized, so that the device according to the present invention requires only a relatively small electric energy which is enough for rotating the actuating plates, and it will be readily appreciated that the intended ball return operation can be realized by the energy of a battery or batteries accommodated in the device which requires no connecting cord to any external commercial power source. Thus attained high portability of the device can be enhanced by a provision of a grip 59 preferably on the rear side of the main housing 12, allowing the device to be carried to any desired practicing place to be excellent in the handling convenience.

What is claimed as our invention is:

1. A golf putting practice device comprising a ramp having a hole made therein for receiving a golf ball putted by a player, means disposed on the rear side of said ramp for conveying said ball caused to roll through said means to one lateral side of the ramp, means including a member rockable between a non-actuated position inside the hole to receive the ball dropped into the hole and an actuated position outside the hole for lifting the ball to have it discharged out of the hole rearward to said conveying means, and means disposed on said one lateral side of the ramp to receive the ball from the conveying means for returning the ball back to the player resiliently along the one lateral side of the ramp, said rockable member of said ball lifting means being pivotably supported to swing from said non-actuated position where the member lies in the bottom of said hole to said actuated position where the member is upright; said ball lifting means comprises a first pair of movable and fixed contactors which are closed by said ball received by the rockable member, a first motor energized upon said closing of said first pair of contactors, a first actuation plate rotated by said first motor, and an arm member linked to the rockable member and movable for swinging the rockable member in response to said rotation of said first actuation plate.

2. A device according to claim 1, wherein said ramp is surrounded on its rear and both lateral sides by a housing, said housing comprising a main housing part lying along the rear side and two side wall parts integrally connected to said main housing part and lying respectively along each of the lateral sides of the ramp, said ball conveying means comprises a ball rolling track extending along said main housing part as sloped into one of said side wall parts of said housing, and said ball returning means is disposed inside and on the rear side of said one side wall part of the housing through which a ball return path is provided.

3. A device according to claim 2, wherein said main housing part is provided with a count display to which an IN signal is provided from a pair of contactors operatively associated with said rockable member of said ball lifting means, and OUT detectors are provided on both sides of said hole to provide OUT signals to said display.

4. A device according to claim 1, wherein said ball lifting means further comprises a second pair of movable and fixed contactors which are closed in response to said rotation of said first actuation plate for supplying therethrough a power of said first motor during said swinging of said rockable member.

5. A device according to claim 1, wherein said ball returning means comprises an arm member provided to be movable in forward and rearward directions with respect to said hole, a spring for biasing said arm member always in said forward direction, a third pair of movable and fixed contactors closed by said ball received from said conveying means, a second motor energized upon said closing of said third pair of contactors, and a second actuation plate rotated by said second motor and capable of retreating the arm member against the biasing force of said spring.

6. A device according to claim 1 which further comprises a battery receptacle and a battery incorporated in said receptacle for supplying a power to said motor.

7. A golf putting practice device comprising a ramp having a hole made therein for receiving a golf ball putted by a player, means disposed on the rear side of said ramp for conveying said ball caused to roll through said means to one lateral side of the ramp, means including a member rockable between a non-actuated position inside the hole to receive the ball dropped into the hole and an actuated position outside the hole for lifting the ball to have it discharged out of the hole rearward to said conveying means, and means disposed on said one lateral side of the ramp to receive the ball from the conveying means for returning the ball back to the player resiliently along the one lateral side of the ramp, said ball returning means comprising an arm member provided to be movable in forward and rearward directions with respect to said hole, a spring for biasing said arm member always in said forward direction, a pair of movable and fixed contactors closed by said ball received from said conveying means, a motor energized upon said closing of said pair of contactors, and an actuation plate rotated by said motor and capable of retreating the arm member against the biasing force of said spring.

8. A golf putting practice device comprising a ramp having a hole made therein for receiving a golf ball putted by a player, means disposed on the rear side of said ramp for conveying said ball caused to roll through said means to one lateral side of the ramp, means including a member rockable between a non-actuated position inside the hole to receive the ball dropped into the hole and an actuated position outside the hole for lifting the ball to have it discharged out of the hole rearward to said conveying means, and means disposed on said one lateral side of the ramp to receive the ball from the conveying means for returning the ball back to the player resiliently along the one lateral side of the ramp, said ramp surrounded on its rear and both lateral sides by a housing, said housing comprising a main housing part lying along the rear side and two side wall parts integrally connected to said main housing part and lying respectively along each of the lateral sides of the ramp, said ball conveying means comprises a ball rolling track extending along said main housing part as sloped into one of said side wall parts of said housing, and said ball returning means is disposed inside and on the rear side of said one side wall part of the housing through which a ball return path is provided, said main housing part provided with a count display to which an IN signal is provided from a pair of contactors operatively associated with said rockable member of said ball lifting means, and OUT detectors are provided on both sides of said hole to provide OUT signals to said display.

9. A device according to claim 8, wherein said rockable member of said ball lifting means is pivotably supported to swing from said non-actuated position where the member lies in the bottom of said hole to said actuated position where the member is upright; a first motor energized upon said closing of said pair of contactors, a first actuation plate rotated by said first motor, and an arm member linked to the rockable member and movable for swinging the rockable member in response to said rotation of said first actuation plate.

* * * * *